US010676325B1

(12) United States Patent
Dell

(10) Patent No.: US 10,676,325 B1
(45) Date of Patent: Jun. 9, 2020

(54) HOIST TRACK ADAPTOR

(71) Applicant: Willie Dell, Harrison, GA (US)

(72) Inventor: Willie Dell, Harrison, GA (US)

( * ) Notice: Subject to any disclaimer, the term of this patent is extended or adjusted under 35 U.S.C. 154(b) by 265 days.

(21) Appl. No.: 15/906,122

(22) Filed: Feb. 27, 2018

(51) Int. Cl.
*B66C 11/14* (2006.01)
*B66C 19/00* (2006.01)
*B66C 7/02* (2006.01)

(52) U.S. Cl.
CPC ..... *B66C 11/14* (2013.01); *B66C 7/02* (2013.01); *B66C 19/00* (2013.01); *B66C 2700/012* (2013.01); *B66C 2700/014* (2013.01)

(58) Field of Classification Search
CPC .. B61B 3/00; B61B 3/02; B61B 10/00; B61B 10/02; B61B 13/00; B61B 13/02; B61B 13/04
See application file for complete search history.

(56) References Cited

U.S. PATENT DOCUMENTS 4,144,973 A 3/1979 Reale
4,480,157 A * 10/1984 Ishikura ..... B61C 13/04 104/93
5,052,566 A 10/1991 Ziegler
5,427,356 A 6/1995 Krotov
6,286,695 B1 9/2001 Tetreault
6,386,513 B1 5/2002 Kazerooni
7,775,384 B2 8/2010 Zaguroli, Jr.
D713,613 S 9/2014 Miles

FOREIGN PATENT DOCUMENTS

WO 2096794 A 12/2002

* cited by examiner

*Primary Examiner* — Robert J McCarry, Jr.

(57) ABSTRACT

The hoist track adapter is configured for use with a hoist. The hoist track adapter is configured for use with an I-beam. The hoist track adapter attaches the hoist to the I-beam. The hoist track adapter enables the hoist to move along the track formed by the I-beam while the hoist is under load. The hoist track adapter comprises a cross beam, a plurality of beam trolleys, a plurality of brackets, and a plurality of bolts and nuts. The plurality of bolts and nuts: 1) attach the plurality of beam trolleys to the cross beam; and, 2) attach the plurality of brackets to the cross beam. The plurality of beam trolleys attaches the cross beam to the I-beam. The plurality of brackets attaches the cross beam to the hoist.

19 Claims, 4 Drawing Sheets

HOIST TRACK ADAPTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including hoisting, lifting, and hauling, more specifically, a platform that suspends a hoist.

SUMMARY OF INVENTION

The hoist track adapter is configured for use with a hoist. The hoist track adapter is configured for use with an I-beam. The hoist track adapter attaches the hoist to the I-beam. The hoist track adapter enables the hoist to move along the track formed by the I-beam while the hoist is under load. The hoist track adapter comprises a cross beam, a plurality of beam trolleys, a plurality of brackets, and a plurality of bolts and nuts. The plurality of bolts and nuts: 1) attach the plurality of beam trolleys to the cross beam; and, 2) attach the plurality of brackets to the cross beam. The plurality of beam trolleys attaches the cross beam to the I-beam. The plurality of brackets attaches the cross beam to the hoist.

These together with additional objects, features and advantages of the hoist track adapter will be readily apparent to those of ordinary skill in the art upon reading the following detailed description of the presently preferred, but nonetheless illustrative, embodiments when taken in conjunction with the accompanying drawings.

In this respect, before explaining the current embodiments of the hoist track adapter in detail, it is to be understood that the hoist track adapter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hoist track adapter.

It is therefore important that the claims be regarded as including such equivalent construction insofar as they do not depart from the spirit and scope of the hoist track adapter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
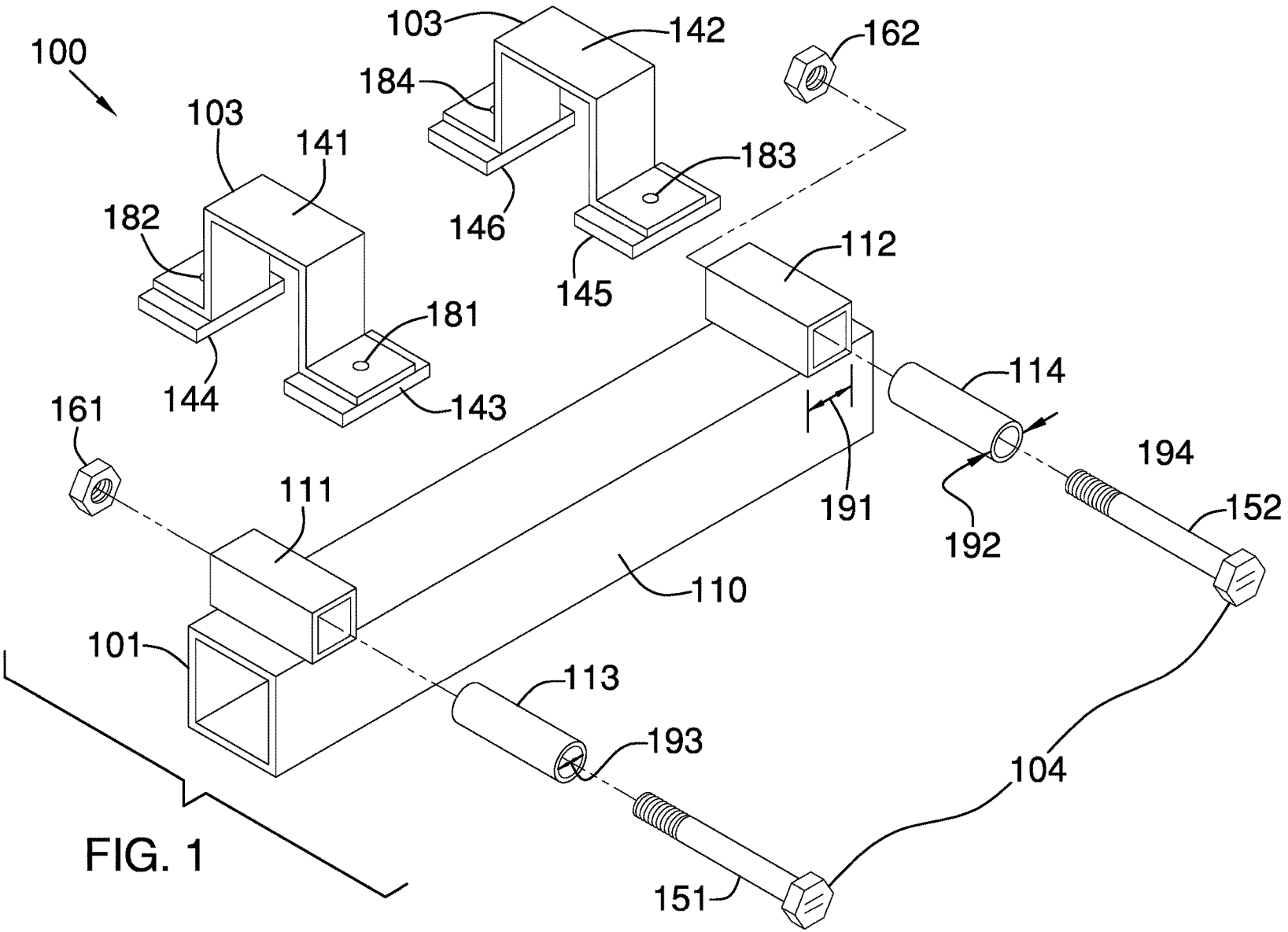
FIG. 1 is a perspective view of an embodiment of the disclosure.
Figure 2:
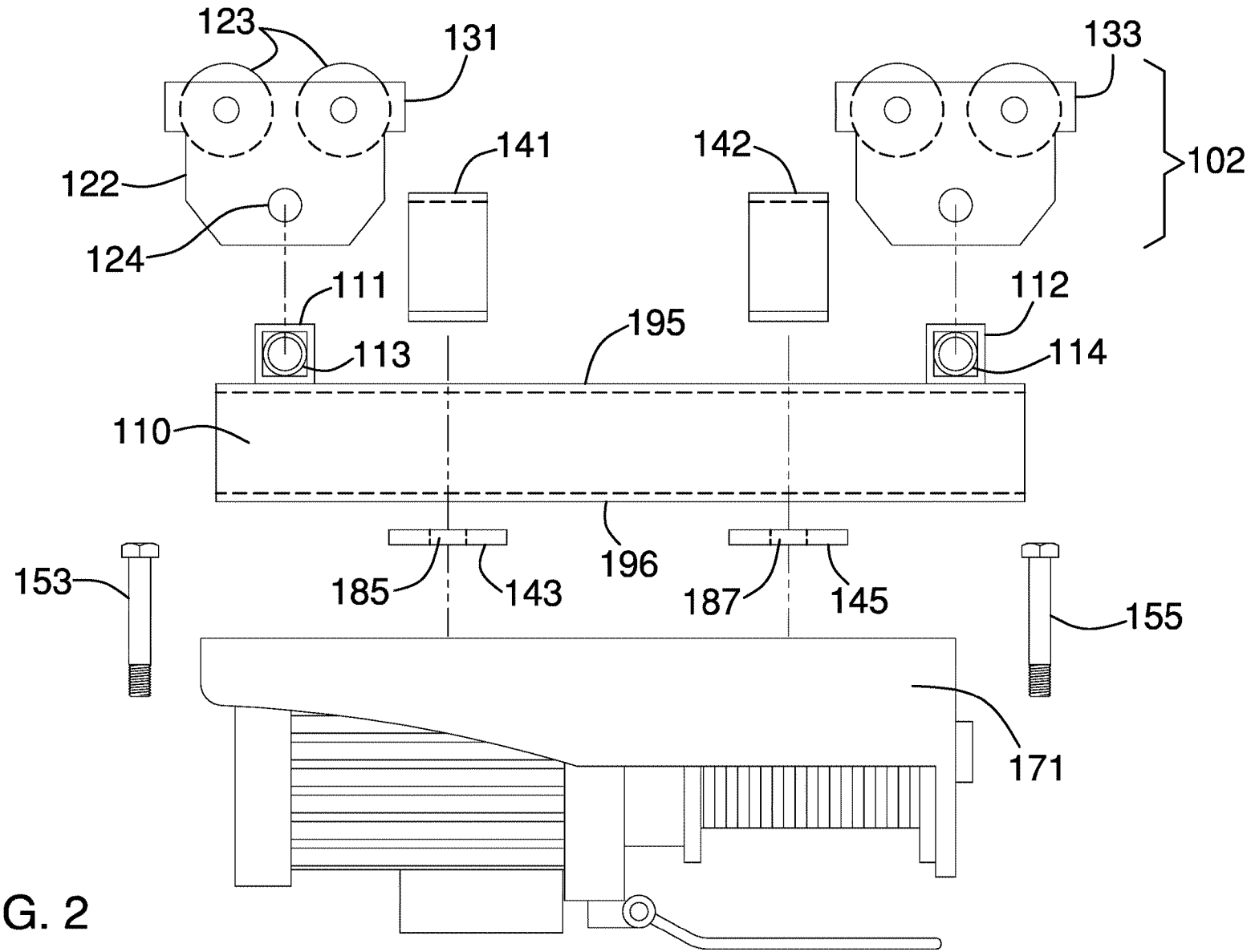
FIG. 2 is an exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The hoist track adapter 100 (hereinafter invention) is configured for use with a hoist 171. The invention 100 is configured for use with an I-beam 172. The I-beam 172 is further defined with a web 173, an inferior flange 174, and a superior flange 175. The invention 100 attaches the hoist 171 to the I-beam 172. The invention 100 enables the hoist 171 to move along the track formed by the I-beam 172 while the hoist 171 is under load. The invention 100 comprises a cross beam 101, a plurality of beam trolleys 102, a plurality of brackets 103, and a plurality of bolts and nuts 104. The plurality of bolts and nuts 104: 1) attach the plurality of beam trolleys 102 to the cross beam 101; and, 2) attach the plurality of brackets 103 to the cross beam 101. The plurality of beam trolleys 102 attaches the cross beam 101 to the I-beam 172. The plurality of brackets 103 attaches the cross beam 101 to the hoist 171.

The hoist 171 is an electrically powered lifting device that hangs from the I-beam 172. The I-beam 172 is an iron or steel structure used in creating a load path for forces that applied across a horizontal surface. The I-beam 172 is well-known and documented in the mechanical and civil engineering arts. The web 173 is a vertically oriented plate that attaches the inferior flange 174 to the superior flange 175. The inferior flange 174 is a horizontally oriented plate that forms the inferior surface of the I-beam 172. The superior flange 175 is a horizontally oriented plate that forms the superior surface of the I-beam 172.

The cross beam 101 is the primary structure of the invention 100. The plurality of beam trolleys 102 and the plurality of brackets 103 both attach to the cross beam 101. The cross beam 101 comprises an adapter tube 110, a first connector tube 111, and a second connector tube 112. The adapter tube 110 is further defined with an inferior face 195 and a superior face 196. The first connector tube 111 and the second connector tube 112 are identical. The first connector tube 111 is further defined with connector inner dimensions 191. The second connector tube 112 is further defined with connector inner dimensions 191.

The adapter tube 110 is a readily and commercially available steel square tube. As shown most clearly in FIG. 3, the hoist 171 is suspended from the invention 100 from the adapter tube 110. When the invention 100 is properly suspended from the I-beam 172, the center axis of the adapter tube 110 runs parallel to the plane formed by the web 173 of the I-beam 172.

The first connector tube 111 further comprises a first bushing 113. The second connector tube 112 further comprises a second bushing 114. The first bushing 113 and the second bushing 114 are identical. The first bushing 113 is further defined with a bushing outer diameter 192 and a bushing inner diameter 193. The second bushing 114 is further defined with a bushing outer diameter 192 and a bushing inner diameter 193.

The span of the bushing outer diameter 192 of the first bushing 113 is lesser than the span of the connector inner dimensions 191 of the first connector tube 111 such that the first bushing 113 can be inserted into the first connector tube 111. The span of the bushing outer diameter 192 of the second bushing 114 is lesser than the span of the connector inner dimensions 191 of the second connector tube 112 such that the second bushing 114 can be inserted into the second connector tube 112.

The first connector tube 111 is a readily and commercially available steel square tube. The first connector tube 111 is welded to the superior face 196 of the adapter tube 110. The second connector tube 112 is a readily and commercially available steel square tube. The second connector tube 112 is welded to the superior face 196 of the adapter tube 110. The first bushing 113 is a readily and commercially available steel cylindrical tube. The second bushing 114 is a readily and commercially available steel cylindrical tube.

The plurality of beam trolleys 102 attach the cross beam 101 to the I-beam 172. Each of the plurality of beam trolleys 102 is a readily and commercially available beam trolley. A beam trolley is also commonly referred to as a push trolley and a manual trolley. The plurality of beam trolleys 102 comprises a collection of individual beam trolleys 121. Each individual beam trolley 121 selected from the plurality of beam trolleys 102 is identical. Each individual beam trolley 121 comprises a base plate 122, a plurality of rollers 123, and a mounting hole 124.

Each individual beam trolley 121 is identical. The base plate 122 is a rectilinear plate upon which the plurality of rollers 123 are mounted such that each of the plurality of rollers 123 can rotate freely. Each of the plurality of rollers 123 is identical. Each of the plurality of rollers 123 is a wheel. Each of the plurality of rollers 123 rests on the superior surface of the inferior flange 174 such that the individual beam trolley 121 can roll freely along the length of the I-beam 172.

In the first potential embodiment of the disclosure, the plurality of beam trolleys 102 comprises a first beam trolley 131, a second beam trolley 132, a third beam trolley 133, and a fourth beam trolley 134. The first beam trolley 131 attaches to the first connector tube 111. The second beam trolley 132 attaches to the first connector tube 111. The third beam trolley 133 attaches to the second connector tube 112. The fourth beam trolley 134 attaches to the second connector tube 112.

The plurality of brackets 103 attach the cross beam 101 to the hoist 171. Each of the plurality of brackets 103 is a readily and commercial hardware item. The plurality of brackets 103 comprises a first U bracket 141 and a second U bracket 142. The first U bracket 141 further comprises a first spacer 143 and a second spacer 144. The second U bracket 142 further comprises a third spacer 145 and a fourth spacer 146.

The first U bracket 141 is further defined with a first mounting aperture 181 and a second mounting aperture 182. The second U bracket 142 is further defined with a third mounting aperture 183 and a fourth mounting aperture 184. The first spacer 143 is further defined with a fifth mounting aperture 185. The second spacer 144 is further defined with a sixth mounting aperture 186. The third spacer 145 is further defined with a seventh mounting aperture 187. The fourth spacer 146 is further defined with an eighth mounting aperture 188.

The first mounting aperture 181 is a circular hole formed in the first U bracket 141. The second mounting aperture 182 is a circular hole formed in the first U bracket 141. The third mounting aperture 183 is a circular hole formed in the second U bracket 142. The fourth mounting aperture 184 is a circular hole formed in the second U bracket 142. The fifth mounting aperture 185 is a circular hole formed in the first spacer 143. The sixth mounting aperture 186 is a circular hole formed in the second spacer 144. The seventh mounting aperture 187 is a circular hole formed in the third spacer 145. The eighth mounting aperture 188 is a circular hole formed in the fourth spacer 146.

The inner diameters of the first mounting aperture 181, the second mounting aperture 182, the third mounting aperture 183, the fourth mounting aperture 184, the fifth mounting aperture 185, the sixth mounting aperture 186, the seventh mounting aperture 187, and the eighth mounting aperture 188 are identical.

The first U bracket 141 is a readily and commercially available U shaped bracket. The U bracket is also commonly referred to as a stake pocket or a bar holder. As shown most clearly in FIGS. 3 and 4, the first U bracket 141 wraps around the superior face 196 of the adapter tube 110 such that the hoist 171 is suspended from the adapter tube 110. The hoist 171 is bolted to the first U bracket 141 using the plurality of bolts and nuts 104.

The second U bracket 142 is a readily and commercially available U shaped bracket. The U bracket is also commonly referred to as a stake pocket or a bar holder. As shown most clearly in FIGS. 3 and 4, the second U bracket 142 wraps around the superior face 196 of the adapter tube 110 such that the hoist 171 is suspended from the adapter tube 110. The hoist 171 is bolted to the second U bracket 142 using the plurality of bolts and nuts 104.

The first spacer 143 is a sacrificial structure located between the first U bracket 141 and the hoist 171. The first spacer 143 is a metal spacer that prevents the first U bracket 141 from damaging the hoist 171. The second spacer 144 is a sacrificial structure located between the first U bracket 141 and the hoist 171. The second spacer 144 is a metal spacer that prevents the first U bracket 141 from damaging the hoist 171. The third spacer 145 is a sacrificial structure located between the second U bracket 142 and the hoist 171. The third spacer 145 is a metal spacer that prevents the second U bracket 142 from damaging the hoist 171. The fourth spacer 146 is a sacrificial structure located between the second U bracket 142 and the hoist 171. The fourth spacer 146 is a metal spacer that prevents the second U bracket 142 from damaging the hoist 171.

The plurality of bolts and nuts 104 is a collection of commercially available hardware items that form threaded connections. The plurality of bolts and nuts 104: 1) secures the plurality of beam trolleys 102 to the cross beam 101; and, 2) secures the plurality of brackets 103 to the hoist 171. The plurality of bolts and nuts 104 comprises a first bolt 151, a second bolt 152, a third bolt 153, a fourth bolt 154, a fifth bolt 155, a sixth bolt 156, a first nut 161, and a second nut 162. The first bolt 151 and the second bolt 152 are identical. The third bolt 153, the fourth bolt 154, the fifth bolt 155, and the sixth bolt 156 are identical.

The span of the bolt outer diameter 194 of a bolt selected from the group consisting of the first bolt 151, the second bolt 152 is lesser than the span of the bushing inner diameter 193 of the first bushing 113. The span of the bolt outer diameter 194 of a bolt selected from the group consisting of the first bolt 151 and the second bolt 152 is lesser than the span of the bushing inner diameter 193 of the second bushing 114.

The bolt outer diameter 194 of a bolt selected from the group consisting of the third bolt 153 and the fourth bolt 154 the fifth bolt 155 and the sixth bolt 156 is lesser than the inner diameter of any mounting aperture selected from the group consisting of the first mounting aperture 181, the second mounting aperture 182, the third mounting aperture 183, the fourth mounting aperture 184, the fifth mounting aperture 185, the sixth mounting aperture 186, the seventh mounting aperture 187, and the eighth mounting aperture 188.

The assembly of the invention 100 is described in the following seven paragraphs.

The first connector tube 111 attaches to the superior face 196 of the adapter tube 110 such that the center axis of the first connector tube 111 is perpendicular to the center axis of the adapter tube 110. The second connector tube 112 attaches to the superior face 196 of the adapter tube 110 such that the center axis of the second connector tube 112 is perpendicular to the center axis of the adapter tube 110.

The first bushing 113 inserts into the first connector tube 111. The first bolt 151 inserts through the mounting hole 124 of the first beam trolley 131. The first bolt 151 inserts through the first bushing 113 and the first connector tube 111. The first bolt 151 inserts through the mounting hole 124 of the second beam trolley 132. The first nut 161 screws on to the first bolt 151 such that: 1) the first beam trolley 131 and the second beam trolley 132 are secured to opposite faces of the adapter tube 110; 2) the plurality of rollers 123 of the first beam trolley 131 are installed on the superior surface of the inferior flange 174 of the I-beam 172; 3) and, the plurality of rollers 123 of the second beam trolley 132 are installed on the superior surface of the inferior flange 174 of the I-beam 172 on the opposite side of the web 173 of the I-beam 172 from the first beam trolley 131.

The second bushing 114 inserts into the second connector tube 112. The second bolt 152 inserts through the mounting hole 124 of the third beam trolley 133. The second bolt 152 inserts through the second bushing 114 and the second connector tube 112. The second bolt 152 inserts through the mounting hole 124 of the fourth beam trolley 134. The second nut 162 screws on to the second bolt 152 such that: 1) the third beam trolley 133 and the fourth beam trolley 134 are secured to opposite faces of the adapter tube 110; 2) the plurality of rollers 123 of the third beam trolley 133 are installed on the superior surface of the inferior flange 174 of the I-beam 172; 3) and, the plurality of rollers 123 of the fourth beam trolley 134 are installed on the superior surface of the inferior flange 174 of the I-beam 172 on the opposite side of the web 173 of the I-beam 172 from the third beam trolley 133.

The first spacer 143 is placed on the hoist 171 such that the fifth mounting aperture 185 aligns with a mounting hole of the hoist 171. The second spacer 144 is placed on the hoist 171 such that the sixth mounting aperture 186 aligns with a mounting hole of the hoist 171. The third spacer 145 is placed on the hoist 171 such that the seventh mounting aperture 187 aligns with a mounting hole of the hoist 171. The fourth spacer 146 is placed on the hoist 171 such that the eighth mounting aperture 188 aligns with a mounting hole of the hoist 171.

The first U bracket 141 is placed on the hoist 171 such that the first mounting aperture 181 aligns with the fifth mounting aperture 185 and the second mounting aperture 182 aligns with the sixth mounting aperture 186. The second U bracket 142 is placed on the hoist 171 such that the third mounting aperture 183 aligns with the seventh mounting aperture 187 and the fourth mounting aperture 184 aligns with the eighth mounting aperture 188.

The third bolt 153 inserts through both the first mounting aperture 181 and the fifth mounting aperture 185 into the mounting hole of the hoist 171. The fourth bolt 154 inserts through both the second mounting aperture 182 and the sixth mounting aperture 186 into the mounting hole of the hoist 171. The fifth bolt 155 inserts through both the third mounting aperture 183 and the seventh mounting aperture 187 into the mounting hole of the hoist 171. The sixth bolt 156 inserts through both the fourth mounting aperture 184 and the eighth mounting aperture 188 into the mounting hole of the hoist 171.

Figure 3:
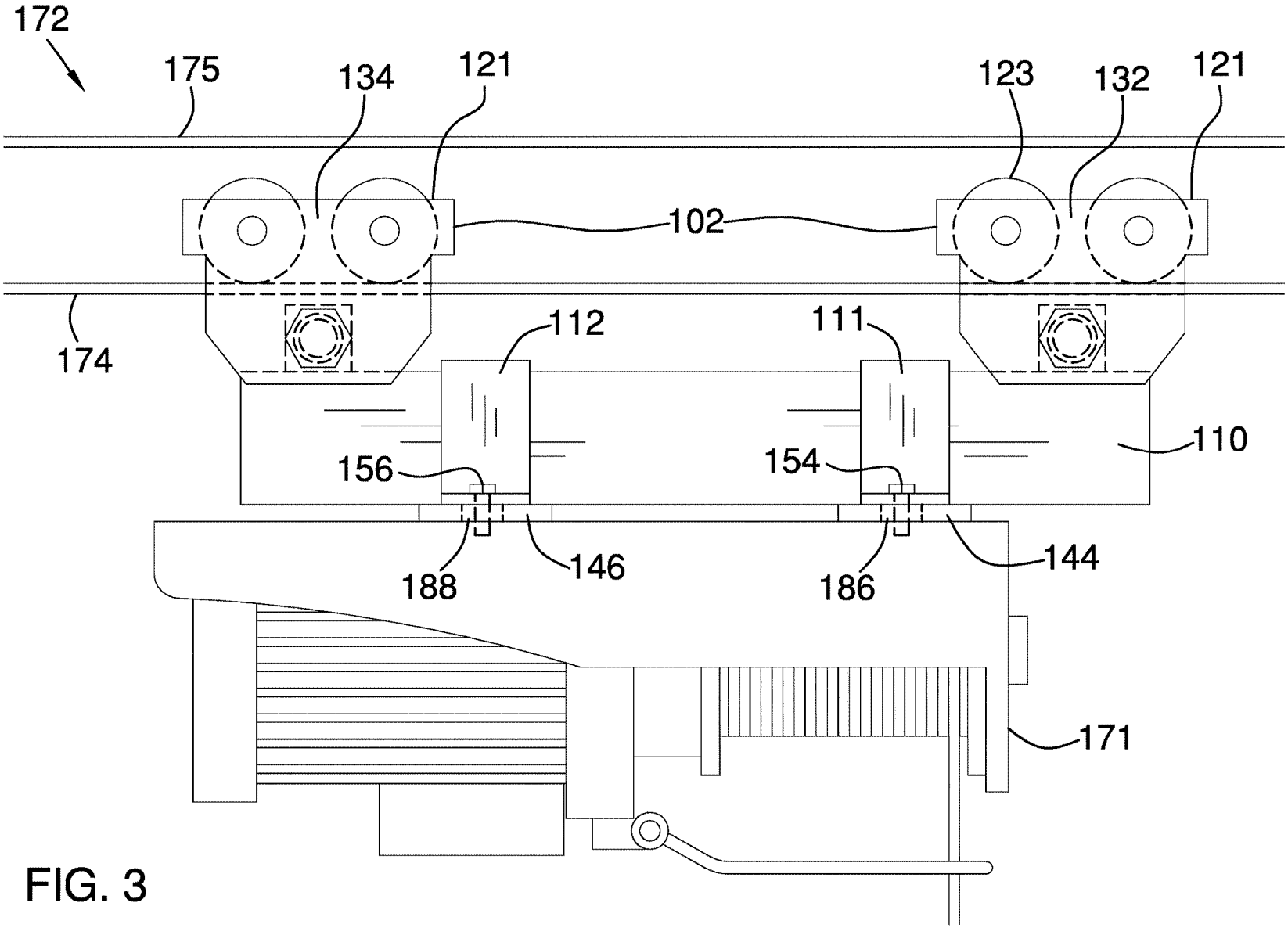
FIG. 3 is an in use view of an embodiment of the disclosure.
Figure 4:
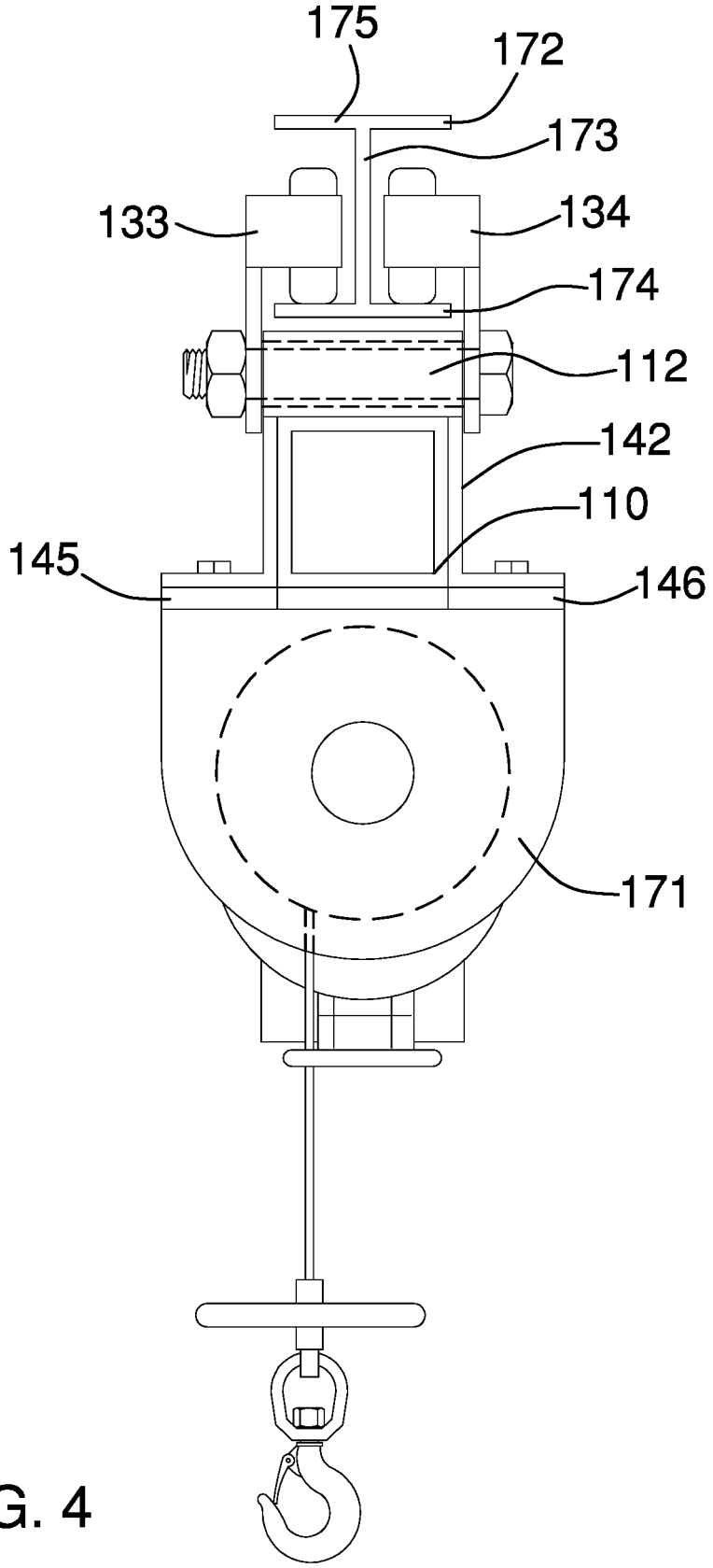
FIG. 4 is an end view of an embodiment of the disclosure.

The third bolt 153 extends through the adaptor tube 110, and screws directly to the hoist 171 (see FIG. 3). The fourth bolt 154 extends through the adaptor tube 110, and screws directly to the hoist 171 (see FIG. 3). The fifth bolt 155 screws directly to the hoist 171, and also passes through the adapter tube 110. The sixth bolt 156 screws directly to the hoist, and also passes through the adapter tube 110.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Beam: As used in this disclosure, a beam is a horizontally oriented load bearing structure that is commonly used to support a floor or a roof of a building.

Bolt: As used in this disclosure, a bolt is a cylindrical shaft formed with an exterior screw thread. A bolt is defined with an outer diameter.

Bracket: As used in this disclosure, a bracket is a mechanical structure that attaches a second structure to a first structure such that the load path of the second structure fully transfers to the first structure.

Bushing: As used in this disclosure, a bushing is a cylindrical aperture through which an object is guided and potentially secured. Bushings are often used as protective linings.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Electric Motor: In this disclosure, an electric motor is a machine that converts electric energy into rotational mechanical energy.

Exterior Screw Thread: An exterior screw thread is a ridge wrapped around the outer surface of a tube in the form of a helical structure that is used to convert rotational movement into linear movement.

Hoist: As used in this disclosure, a hoist is an electrically powered device lifts objects from a location that is above the object. A hoist is a form of a winch.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

I-Beam: As used in this disclosure, an I-beam is a beam, generally made of iron or steel, which has a cross-section that forms an "I" shape. The I-beam is a well-known and commercially available beam. The I-beam is further defined with a web, a first flange, and a second flange. The web attaches the first flange to the second flange.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Load Path: As used in this disclosure, a load path refers to a chain of one or more structures that transfers a load generated by a raised structure or object to a foundation, supporting surface, or the earth.

Motor: As used in this disclosure, a motor refers to the method of transferring energy from an external power source into mechanical energy.

Nut: As used in this disclosure, a nut is a first object formed with a cylindrical negative space that further comprises an interior screw thread such that a second object with a matching exterior screw thread can screw into the first object forming a threaded connection. A nut is further defined with an inner diameter.

Plate: As used in this disclosure, a plate is a smooth, flat and semi-rigid or rigid structure that has at least one dimension that: 1) is of uniform thickness; and, 2) that appears thin relative to the other dimensions of the object. Plates often have a rectangular or disk like appearance.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism is named for the geometric or descriptive name of the form factor of the two congruent faces. If the form factor of the two congruent faces has no established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A cylinder is a prism with two congruent faces that are circles.

Outer Diameter: As used in this disclosure, the term outer diameter is used in the same way that a plumber would refer to the outer diameter of a pipe.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Roll: As used in this disclosure, the term roll refers to the motion of an object facilitated by the rotation of one or more wheels or casters.

Screw: When used as a verb in this disclosure, to screw means: 1) to fasten or unfasten (unscrew) a threaded connection; or 2) to attach a helical structure to a solid structure.

Sacrificial Structure: As used in this disclosure, a sacrificial structure is a first object or structure that protects a second object or structure from damage. More specifically, the sacrificial structure protects the second object or structure by being damaged instead of the second object or structure.

Spool: As used in this disclosure, a spool is a cylindrical device upon which a flexible material, including but not limited to a yarn, a cord, or a tape, can be wound.

Superior: As used in this disclosure, the term superior refers to a directional reference that is parallel to and in the opposite direction of the force of gravity.

Threaded Connection: As used in this disclosure, a threaded connection is a type of fastener that is used to join a first tube shaped and a second tube shaped object. The first tube shaped object is fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Tube: As used in this disclosure, a tube is a hollow prism shaped device used for transporting liquids and gases. The line that connects the center of the first congruent face of the prism to the center of the second congruent face of the prism is referred to as the center axis of the tube or the centerline of the tube. When two tubes share the same center line they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Winch: As used in this disclosure, a winch is a device that comprises a cord and a rotating spool. The cord is wound on the spool. The winch is used to move or lift an object by: 1) partially unwinding the cord from the rotating spool; 2) attaching the free end of the cord to the object to be moved or lifted; and, 3) winding the cord back on to the rotating spool in order to move or lift the object.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A suspension apparatus comprising:

a cross beam, a plurality of beam trolleys, and a plurality of brackets;

wherein the plurality of beam trolleys attaches the cross beam to the I-beam;

wherein the plurality of brackets attaches the cross beam to the hoist;

wherein the suspension apparatus is configured for use with a hoist;

wherein the suspension apparatus is configured for use with an I-beam;

wherein the I-beam is further defined with a web, an inferior flange, and a superior flange;

wherein the suspension apparatus attaches the hoist to the I-beam;

wherein the hoist lifts a load;

wherein the suspension apparatus enables the hoist to move along a track formed by the I-beam while the hoist is under load;

wherein the cross beam comprises an adapter tube, a first connector tube, and a second connector tube;

wherein the first connector tube and the second connector tube attach to the adapter tube;

wherein the adapter tube is further defined with an inferior face and a superior face;

wherein the first connector tube and the second connector tube are identical;

wherein the first connector tube is further defined with connector inner dimensions;

wherein the second connector tube is further defined with connector inner dimensions.

2. The suspension apparatus according to claim 1 wherein the adapter tube is a steel square tube;

wherein the hoist is suspended by the suspension apparatus from the adapter tube;

wherein the center axis of the adapter tube runs parallel to the plane formed by the web of the I-beam.

3. The suspension apparatus according to claim 2 wherein the first connector tube further comprises a first bushing;

wherein the first connector tube attaches to the adapter tube;

wherein the second connector tube further comprises a second bushing;

wherein the second connector tube attaches to the adapter tube;

wherein the first bushing is further defined with a bushing outer diameter and a bushing inner diameter;

wherein the second bushing is further defined with a bushing outer diameter and a bushing inner diameter.

4. The suspension apparatus according to claim 3 wherein the first bushing and the second bushing are identical;

wherein the span of the bushing outer diameter of the first bushing is lesser than the span of the connector inner dimensions of the first connector tube such that the first bushing inserts into the first connector tube;

wherein the span of the bushing outer diameter of the second bushing is lesser than the span of the connector inner dimensions of the second connector tube such that the second bushing inserts into the second connector tube.

5. The suspension apparatus according to claim 4 wherein the first connector tube is a steel square tube;

wherein the second connector tube is a steel square tube;

wherein the first bushing is a steel cylindrical tube;

wherein the second bushing is a cylindrical tube.

6. The suspension apparatus according to claims wherein the first connector tube is welded to the superior face of the adapter tube;

wherein the second connector tube is welded to the superior face of the adapter tube.

7. The suspension apparatus according to claim 6 wherein the plurality of beam trolleys comprises a collection of individual beam trolleys;

wherein each individual beam trolley selected from the plurality of beam trolleys is identical;

wherein each individual beam trolley comprises a base plate, a plurality of rollers, and a mounting hole;

wherein the plurality of rollers are mounted on the base plate;

wherein the mounting hole is formed through the base plate.

8. The suspension apparatus according to claim 7,
wherein the base plate is a rectilinear plate;
wherein the plurality of rollers mount on the base plate such that each of the plurality of rollers can rotate freely;
wherein each of the plurality of rollers is identical;
wherein each of the plurality of rollers rests on the superior surface of the inferior flange such that the individual beam trolley can roll freely along the length of the I-beam.

9. The suspension apparatus according to claim 8,
wherein the plurality of beam trolleys comprises a first beam trolley, a second beam trolley, a third beam trolley, and a fourth beam trolley;
wherein the first beam trolley attaches to the first connector tube;
wherein the second beam trolley attaches to the first connector tube;
wherein the third beam trolley attaches to the second connector tube;
wherein the fourth beam trolley attaches to the second connector tube.

10. The suspension apparatus according to claim 9
wherein the plurality of brackets comprises a first U bracket and a second U bracket;
wherein the first U bracket attaches the hoist to the adapter tube;
wherein the second U bracket attaches the hoist to the adapter tube;
wherein the first U bracket is further defined with a first mounting aperture and a second mounting aperture;
wherein the second U bracket is further defined with a third mounting aperture and a fourth mounting aperture.

11. The suspension apparatus according to claim 10
wherein the first U bracket further comprises a first spacer and a second spacer;
wherein the second U bracket further comprises a third spacer and a fourth spacer;
wherein the first spacer is further defined with a fifth mounting aperture;
wherein the second spacer is further defined with a sixth mounting aperture;
wherein the third spacer is further defined with a seventh mounting aperture;
wherein the fourth spacer is further defined with an eighth mounting aperture.

12. The suspension apparatus according to claim 11
wherein the first mounting aperture is a circular hole formed in the first U bracket;
wherein the second mounting aperture is a circular hole formed in the first U bracket;
wherein the third mounting aperture is a circular hole formed in the second U bracket;
wherein the fourth mounting aperture is a circular hole formed in the second U bracket;
wherein the fifth mounting aperture is a circular hole formed in the first spacer;
wherein the sixth mounting aperture is a circular hole formed in the second spacer;
wherein the seventh mounting aperture is a circular hole formed in the third spacer;
wherein the eighth mounting aperture is a circular hole formed in the fourth spacer;
wherein the inner diameters of the first mounting aperture, the second mounting aperture, the third mounting aperture, the fourth mounting aperture, the fifth mounting aperture, the sixth mounting aperture, the seventh mounting aperture, and the eighth mounting aperture are identical.

13. The suspension apparatus according to claim 12
wherein the first U bracket is a U shaped bracket;
wherein the second U bracket is a U shaped bracket;
wherein the first U bracket wraps around the superior face of the adapter tube such that the hoist is suspended from the adapter tube;
wherein the second U bracket wraps around the superior face of the adapter tube such that the hoist is suspended from the adapter tube.

14. The suspension apparatus according to claim 13
wherein the first spacer is a sacrificial structure located between the first U bracket and the hoist;
wherein the second spacer is a sacrificial structure located between the first U bracket and the hoist;
wherein the third spacer is a sacrificial structure located between the second U bracket and the hoist;
wherein the fourth spacer is a sacrificial structure located between the second U bracket and the hoist;
wherein the first spacer is a metal spacer;
wherein the second spacer is a metal spacer;
wherein the third spacer is a metal spacer;
wherein the fourth spacer is a metal spacer.

15. The suspension apparatus according to claim 14
wherein the suspension apparatus further comprises a plurality of bolts and nuts;
wherein each bolt selected from the plurality of bolts and nuts attaches to a nut selected from the plurality of bolts and nuts forms a threaded connection;
wherein the first beam trolley is bolted to the adapter tube using the plurality of nuts and bolts;
wherein the second beam trolley is bolted to the adapter tube using the plurality of nuts and bolts;
wherein the third beam trolley is bolted to the adapter tube using the plurality of nuts and bolts;
wherein the fourth beam trolley is bolted to the adapter tube using the plurality of nuts and bolts;
wherein the hoist is bolted to the first U bracket using the plurality of bolts and nuts;
wherein the hoist is bolted to the second U bracket using the plurality of bolts and nuts;
wherein the plurality of bolts and nuts further comprises a first bolt, a second bolt, a third bolt, a fourth bolt, a fifth bolt, a sixth bolt, a first nut, a second nut, a third nut, a fourth nut, a fifth nut, and a sixth nut.

16. The suspension apparatus according to claim 15
wherein the first bolt and the second bolt are identical;
wherein the third bolt, the fourth bolt, the fifth bolt, and the sixth bolt are identical;
wherein the span of the bolt outer diameter of a bolt selected from the group consisting of the first bolt, the second bolt is lesser than the span of the bushing inner diameter of the first bushing;
wherein the span of the bolt outer diameter of a bolt selected from the group consisting of the first bolt and the second bolt is lesser than the span of the bushing inner diameter of the second bushing;
wherein the bolt outer diameter of a bolt selected from the group consisting of the third bolt and the fourth bolt the fifth bolt and the sixth bolt is lesser than the inner diameter of any mounting aperture selected from the group consisting of the first mounting aperture, the second mounting aperture, the third mounting aperture, the fourth mounting aperture, the fifth mounting aperture, the sixth mounting aperture, the seventh mounting aperture, and the eighth mounting aperture.

17. The suspension apparatus according to claim 16 wherein the first connector tube attaches to the superior face of the adapter tube such that the center axis of the first connector tube is perpendicular to the center axis of the adapter tube;

wherein the first bushing inserts into the first connector tube;

wherein the first bolt inserts through the mounting hole of the first beam trolley;

wherein the first bolt inserts through the first bushing and the first connector tube;

wherein the first bolt inserts through the mounting hole of the second beam trolley;

wherein the first nut screws on to the first bolt such that the first beam trolley and the second beam trolley are secured to opposite faces of the adapter tube;

wherein the first nut screws on to the first bolt such that the plurality of rollers of the first beam trolley are installed on the superior surface of the inferior flange of the I-beam;

wherein the first nut screws on to the first bolt such that the plurality of rollers of the second beam trolley are installed on the superior surface of the inferior flange of the I-beam on the opposite side of the web of the I-beam from the first beam trolley.

18. The suspension apparatus according to claim 17 wherein the second connector tube attaches to the superior face of the adapter tube such that the center axis of the second connector tube is perpendicular to the center axis of the adapter tube;

wherein the second bushing inserts into the second connector tube;

wherein the second bolt inserts through the mounting hole of the third beam trolley;

wherein the second bolt inserts through the second bushing and the second connector tube;

wherein the second bolt inserts through the mounting hole of the fourth beam trolley;

wherein the second nut screws on to the second bolt such that the third beam trolley and the fourth beam trolley are secured to opposite faces of the adapter tube;

wherein the second nut screws on to the second bolt such that plurality of rollers of the third beam trolley are installed on the superior surface of the inferior flange of the I-beam;

wherein the second nut screws on to the second bolt such that plurality of rollers of the fourth beam trolley are installed on the superior surface of the inferior flange of the I-beam on the opposite side of the web of the I-beam from the third beam trolley.

19. The suspension apparatus according to claim 18 wherein the first spacer is placed on the hoist;

wherein the second spacer is placed on the hoist;

wherein the third spacer is placed on the hoist;

wherein the fourth spacer is placed on the hoist;

wherein the first U bracket is placed on the hoist such that the first mounting aperture aligns with the fifth mounting aperture;

wherein the first U bracket is placed on the hoist such that second mounting aperture aligns with the sixth mounting aperture;

wherein the second U bracket is placed on the hoist such that the third mounting aperture aligns with the seventh mounting aperture;

wherein the second U bracket is placed on the hoist such that the fourth mounting aperture aligns with the eighth mounting aperture;

wherein the third bolt inserts through both the first mounting aperture and the fifth mounting aperture;

wherein the fourth bolt inserts through both the second mounting aperture and the sixth mounting aperture;

wherein the fifth bolt inserts through both the third mounting aperture and the seventh mounting aperture;

wherein the sixth bolt inserts through both the fourth mounting aperture and the eighth mounting aperture;

wherein the third bolt screws directly to secure the hoist;

wherein the fourth bolt screws directly to secure the hoist;

wherein the fifth bolt screws directly to secure the hoist;

wherein the sixth bolt screws directly to secure the hoist.

* * * * *